US009713204B2

(12) United States Patent
Kim et al.

(10) Patent No.: US 9,713,204 B2
(45) Date of Patent: Jul. 18, 2017

(54) MICROWAVE OVEN HAVING A HOOD

(71) Applicant: LG ELECTRONICS INC., Seoul (KR)

(72) Inventors: Wontae Kim, Seoul (KR); Sungbae Song, Seoul (KR); Taeho Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 434 days.

(21) Appl. No.: 13/835,832

(22) Filed: Mar. 15, 2013

(65) Prior Publication Data

US 2013/0240509 A1 Sep. 19, 2013

(30) Foreign Application Priority Data

Mar. 16, 2012 (KR) ..... 10-2012-0027267

(51) Int. Cl.
*H05B 6/80* (2006.01)
*H05B 6/64* (2006.01)
*F24C 15/20* (2006.01)

(52) U.S. Cl.
CPC ..... *H05B 6/80* (2013.01); *F24C 15/2092* (2013.01); *H05B 6/6423* (2013.01)

(58) Field of Classification Search
CPC ..... H05B 6/6423; H05B 6/80; A01B 12/006
USPC ..... 219/679, 68, 756, 757; 126/21 A, 21 R, 126/299 A, 299 D, 299 R, 273 A
See application file for complete search history.

(56) References Cited

U.S. PATENT DOCUMENTS

| | | | | |
|---|---|---|---|---|
| 3,356,008 | A * | 12/1967 | Simpson et al. | 126/299 D |
| 3,496,704 | A * | 2/1970 | Bandlow | 96/138 |
| 6,717,123 | B1 * | 4/2004 | Kim | 219/757 |
| 6,797,930 | B2 * | 9/2004 | Kim | 219/757 |
| 2004/0016754 | A1 * | 1/2004 | Yang | 219/757 |
| 2008/0121223 | A1 * | 5/2008 | Grobleben et al. | 126/299 D |
| 2008/0264933 | A1 * | 10/2008 | Jeong | 219/679 |
| 2010/0200576 | A1 * | 8/2010 | Song et al. | 219/756 |
| 2010/0200578 | A1 * | 8/2010 | Song et al. | 219/757 |
| 2010/0206292 | A1 * | 8/2010 | Tsakiris | 126/299 F |

FOREIGN PATENT DOCUMENTS

| | | | |
|---|---|---|---|
| CN | 1482396 | * | 3/2004 |
| EP | 337935 | * | 10/1989 |
| KR | 10-2004-0102993 | | 12/2004 |
| KR | 10-2007-0051556 | | 5/2007 |
| KR | 10-2008-0063568 | | 7/2008 |
| KR | 10-2010-0091683 | | 8/2010 |

OTHER PUBLICATIONS

Translation of EP 337935.*

* cited by examiner

*Primary Examiner* — David Angwin
*Assistant Examiner* — Frederick Calvetti
(74) *Attorney, Agent, or Firm* — Ked & Associates, LLP

(57) ABSTRACT

Provided is a microwave oven having a hood. The microwave oven having the hood includes a main body having a cooking chamber in which foods are cooked and a passage through which air containing contaminants flows, a hood casing disposed on a lower portion of the main body, a first hood taken out of the hood casing, a second hood tilted at a position different from that of the first hood, the second hood being taken out of the hood casing, and a tilting control device allowing or restricting tilting of the second hood due to a self-weight of the second hood.

15 Claims, 6 Drawing Sheets

MICROWAVE OVEN HAVING A HOOD

CROSS-REFERENCE TO RELATED APPLICATIONS

The present application claims priority under 35 U.S.C. 119 and 35 U.S.C. 365 to Korean Patent Application No. 10-2012-0027267 (filed on Mar. 16, 2012), which is hereby incorporated by reference in its entirety.

BACKGROUND

The present disclosure relate to a microwave oven having a hood.

In general, microwave ovens are home appliances for cooking foods using microwaves. Among these microwave ovens, a microwave oven having a hood function is called a microwave hood combination over or an OTR type microwave oven.

The microwave oven having a hood (hereinafter, referred to as a "microwave oven") is installed on a side of kitchen. In more detail, the microwave oven is installed above other cooking equipment, e.g., a gas oven range. Also, the microwave oven includes a hood. The hood is installed in a lower portion of the microwave oven to suction air containing contaminants generated while the cooking equipment cooks foods. Although not shown, a suction device for suctioning air containing contaminants through the hood is installed within the microwave oven.

However, the microwave oven having the hood according to the related art has the following limitations.

First, the hood is fixed to the lower portion of the microwave oven. Thus, it is substantially difficult to efficiently prevent air containing contaminants from being diffused into a region corresponding to the outside of the hood.

Also, the hood has a flat bottom surface. Thus, a rear end of the hood disposed on a rear end of the bottom of the microwave oven is relatively far from the cooking equipment. Therefore, it may be difficult to efficiently suction air containing contaminants generated while the cooking equipment cooks foods through the hood.

SUMMARY

Embodiments provide a microwave oven having a hood.

In one embodiment, a microwave oven having a hood includes: a main body having a cooking chamber in which foods are cooked and a passage through which air containing contaminants flows; a hood casing disposed on a lower portion of the main body; a first hood taken out of the hood casing; a second hood tilted at a position different from that of the first hood, the second hood being taken out of the hood casing; and a tilting control device allowing or restricting tilting of the second hood due to a self-weight of the second hood.

In another embodiment, a microwave oven having a hood includes: a main body having a cooking chamber in which foods are cooked and a passage through which air containing contaminants flows; a hood casing disposed on a bottom surface of the main body; a first hood slid forward or backward with respect to the hood casing so that the first hood is taken out of the hood casing; a second hood tilted at a predetermined angle with respect to the hood casing so that the second hood is taken out of the hood casing; and a tilting control device restricting tilting of the second hood in a state where the first hood is accommodated into the hood casing.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
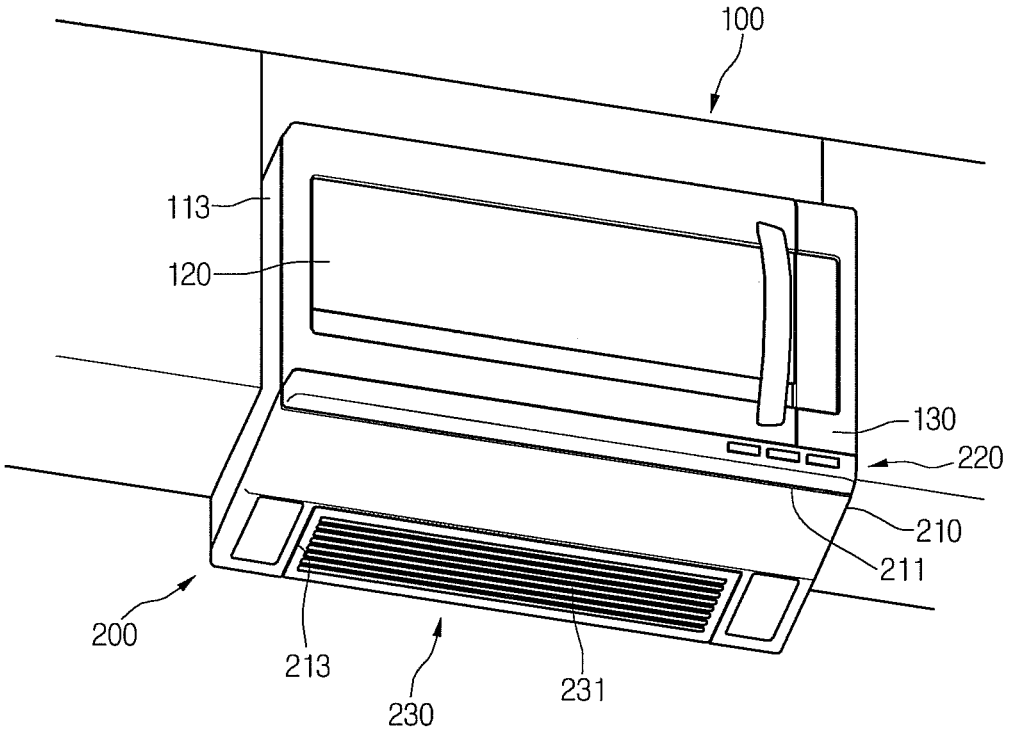
FIG. 1 is a perspective view illustrating a state in which a microwave oven having a hood is installed in a kitchen according to an embodiment.
Figure 2:
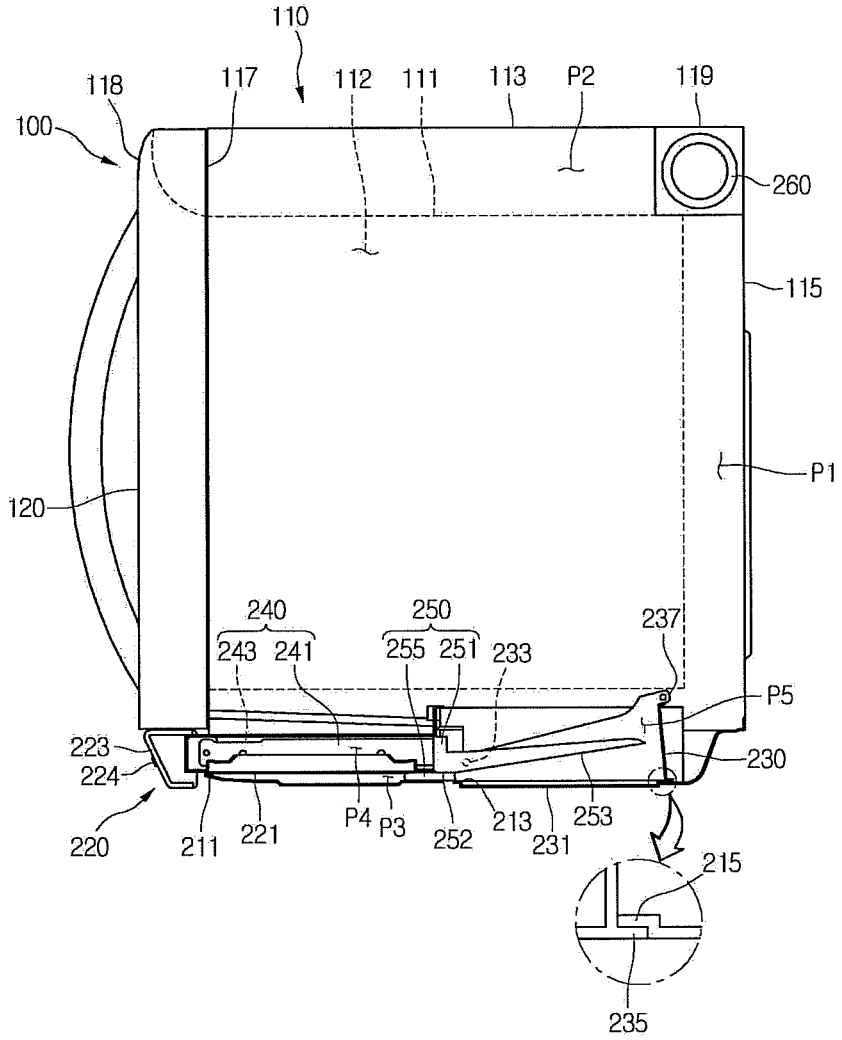
FIG. 2 is a cross-sectional view of a microwave oven having a hood according to an embodiment.

FIG. 1 is a perspective view illustrating a state in which a microwave oven having a hood is installed in a kitchen according to an embodiment, and FIG. 2 is a cross-sectional view of a microwave oven having a hood according to an embodiment.

Referring to FIGS. 1 and 2, a microwave oven 100 having a hood (hereinafter, referred to as a "microwave oven") according to an embodiment includes a main body 110 having a cavity 111. The cavity 111 may have an approximately hexahedral shape with an opened front side. A cooking chamber 112 in which foods are cooked is defined in the cavity 111.

A top surface and both side surfaces of the main body 110 are defined by an outer casing 113. Also, an outer appearance of a rear surface of the main body 110 is defined by a back plate 115. Here, at least top and rear surface of the cavity 111, a top surface of the outer casing 113, and a front surface of the back plate 115 are spaced apart from each other. Substantially, a connection passage P1 is defined between the rear surface of the cavity 111 and the front surface of the back plate 115. An indoor exhaust passage P2 is defined between the top surface of the cavity 111 and the top surface of the outer casing 113. Thus, an upper end of the connection passage P1 and a rear end of the indoor exhaust passage P2 communicate with each other.

An indoor exhaust hole 117 is defined in the main body 110. The indoor exhaust hole 117 is defined in a front upper end of the main body 110. The indoor exhaust hole 117 serves as an outlet through which air is discharged from the inside of the main body 10 into an indoor space.

Also, an exhaust grill 118 is disposed in a front side of the indoor exhaust hole 117. The exhaust grill 118 guides air exhausted through the indoor exhaust hole 117 upward. Also, the exhaust grill 118 may be covered by a door 120 in a state where the door 120 covers the cooking chamber 112. Alternatively, the air exhausted into the indoor space through the indoor exhaust hole 117 may be guided forward by the exhaust grill 118. In this case, the exhaust grill 118 may not be covered by the door 120 that will be described later.

An outdoor exhaust hole 119 is defined in a top surface of the outer casing 113. The outdoor exhaust hole 118 serves as an outlet through which air is discharged from the inside of the main body 10 into an outdoor space. Substantially, the outdoor exhaust hole 119 is defined by cutting a portion of the top surface of the outer casing 113 corresponding to a direct upper side of the connection passage P1. Although not shown, a duct for discharging the air exhausted through the outdoor exhaust hole 119 into the outdoor space may be connected to the outdoor exhaust hole 119.

Also, the door 120 is rotatably disposed on the main body 110. The door 120 selectively opens or closes the cooking chamber 112. For example, the door 120 may rotate with respect to the main body 110 in a side-swing manner.

Also, a control panel 130 is disposed on a front surface of the main body 110. The control panel 130 receives a signal for operating the microwave oven 100 to display information related to the operation of the microwave oven 100.

A hood device 200 is disposed on a lower portion of the main body 110. The hood device 200 is configured to suction air containing contaminants generated while foods are cooked in cooking equipment disposed under the microwave oven 100 into the main body 110. The hood device 200 may include a hood casing 210, first and second hoods 220 and 230, a guide member 240, and a tilting control device 250.

In detail, the hood casing 210 has an approximately polygonal shape with an opened top surface. The hood casing 210 is fixed to the bottom surface of the main body 110. Thus, a space for accommodating the first and second hoods 220 and 230 and a main suction passage P3 through which air suctioned into the main body 110 flows are defined between the bottom surface of the main body 110 and an inner surface of the hood casing 210. A rear end of the main suction passage P3 communicates with a lower end of the connection passage P1.

A first entrance hole 211 is defined in the hood casing 210. The first entrance hole 211 is defined in a front portion of the hood casing 210.

Also, a second entrance 213 is defined in a bottom surface of the hood casing 210. The first entrance hole 211 is defined by cutting a portion of the bottom surface of the hood casing 210. The first entrance hole 211 serves as an entrance through which the first hold 220 is taken in or out. The second entrance hole 213 is defined by cutting a portion of a rear end of the bottom surface of the hood casing 210. The second entrance hole 213 serves as an entrance through which the second hood 230 is taken in or out.

A hook rib 215 is disposed on the hood casing 210. The hook rib 215 is disposed on a side of the rear end of the hood casing 210 corresponding to the second entrance hole 213. Here, the hook rib 215 is spaced upward from the bottom surface of the hood casing 210. Substantially, the hook rib 215 may be spaced a distance corresponding to a thickness of a first stopper 235 (that will be described later) upward from the bottom surface of the hood casing 210.

The first hood 220 may be taken in or out of the hood casing 210 through the first entrance hole 211. In detail, the first hood 220 is slid forward or backward with respect to the hood casing 210 (or the main body 110). Hereinafter, a position at which the first hood 220 is accommodated into the hood casing 210 is called a first accommodation position (see FIG. 2), and a position at which the first hood 220 is taken out of the hood casing 210 is called a first withdrawal position (see FIG. 4).

The first hood 220 has an approximately cross-section corresponding to that of the first entrance hole 211 and an opened rear surface having a polygonal shape, but the present disclosure is not limited thereto. A first suction passage P4 is defined inside the first hood 220. A rear end of the first suction passage P4 communicates with a front end of the main suction passage P3 in a state where the first hood 220 is disposed at the first withdrawal position. The first suction passage P4 may be defined in the state where the first hood 220 is taken out of the hood casing 210, i.e., in the state where the first hood 220 is disposed at the first withdrawal portion.

Also, a first suction hole 221 is defined in the first hood 220. Air containing contaminants is suctioned into the first suction passage P4 through the first suction hole 221. The first suction hole 221 is defined outside the hood casing 210 in the state where the first hood 220 is disposed at the first withdrawal position.

A front panel 223 is disposed on the front surface of the first hood 220. Substantially, the front panel 223 defines an outer appearance of a front surface of the first hood 220. Also, a manipulation button 224 receiving a signal for an operation of the microwave oven 100 may be disposed on the front panel 223. The manipulation button 224 may receive, for example, a signal for operating a suction fan assembly 260 and a lamp (not shown) which will be described later.

The second hood 230 may be taken in or out of the hood casing 210. In detail, the second hood 230 may be tilted at a predetermined angle with respect to the hood casing 210 (or the main body 110).

In the current embodiment, the second hood 230 may be tanked in or out of the hood casing 210 by being linked with the withdrawal of the first hood 220 into/form the hood casing 210. In the current embodiment, the second hood 230 rotates by a self-weight thereof and thus be tilted with respect to the hood casing 210. Hereinafter, a position at which the second hood 230 is accommodated into the hood casing 210 is called a second accommodation position (see FIG. 2), and a position at which the second hood 230 is taken out of the hood casing 210 is called a second withdrawal position (see FIG. 4).

The second hood 230 has an approximately cross-section corresponding to that of the second entrance hole 213 and opened front and top surfaces each having a polygonal shape, but the present disclosure is not limited thereto. The second hood 230 defines a second suction passage P5. An upper end of the second suction passage P5 communicates with the rear end of the main suction passage P3 when the second hood 230 is taken out of the hood casing 210. The second suction passage P5 may be defined only in the state where the second hood 230 is taken out of the hood casing 210, i.e., in a state where the second hood 230 is disposed at the second withdrawal position.

In the state where the second hood 230 is accommodated within the hood casing 210, the bottom surface of the second hood 230 is disposed on the same virtual plane as that of the hood casing 210. Alternatively, in the state where the second hood 230 is accommodated within the hood casing 210, the bottom surface of the second hood 230 may be disposed on a virtual plane parallel to the bottom surface of the hood casing 210. Also, in the state where the second hood 230 is tilted at a predetermined angle with respect to the hood casing 210 and then taken out of the hood casing 210, the bottom surface of the second hood 230 is disposed on a virtual plane that is tilted at a predetermined angle with respect to the bottom surface of the hood casing 210 so that the bottom surface of the second hood 230 faces a front side.

Also, a second suction hole 231 is defined in the bottom surface of the second hood 230. Air containing contaminants is suctioned into the second suction passage P5 through the second suction hole 231. Thus, the second suction hole 231 may be defined in the same plane as the bottom surface of the hood casing 210 or in a virtual plane parallel to the bottom surface of the hood casing 210 or may be defined in a virtual plane that is tilted at a preset angle with respect to the bottom surface of the hood casing 210 to face the front side as the second hood 230 is taken in or out of the hood casing 210.

A tilting pin 233 is disposed on each of both surfaces of the second hood 230. The tilting pin 233 may provides a tilting center the second hood 230 which is taken in or out of the hood casing 210. The tilting pin 233 extends outward from a front end of each of both side surfaces of the second hood 230. Also, the tilting pin 233 is rotatably supported within the hood casing 210.

Also, first and second stoppers 235 and 237 are disposed on rear and upper ends of the bottom surface of the second hood 230, respectively. The first and second stoppers 235 and 237 may selectively contact the hook rib 215 while the second hood 230 is taken in or out of the hood casing 210 to restrict a tilted angle of the second hood 230 with respect to the hood casing 210.

The first stopper 235 extends backward from the bottom surface of the second hood 230. The first stopper 235 prevents the second hood 230 from being relatively further inserted into the hood casing 210 than the second accommodation position. For this, while the second hood 230 is accommodated into the hood casing 210, a top surface of the first stopper 235 contacts a bottom surface of the hook rib 215.

In the current embodiment, the hook rib 215 is spaced upward from the bottom surface of the hood casing 210 by a thickness of the first stopper 235. Thus, in the state where the top surface of the first stopper 235 contacts the bottom surface of the hook rib 215, i.e., in the state where the second hood 230 is disposed at the second accommodation position, the bottom surface of the second hood 230 may be disposed on the same virtual plane as that of the hood casing 210.

The second stopper 237 extends backward from an upper end of the rear surface of the second hood 230. The second stopper 237 prevents the second hood 230 being relatively further taken out of the hood casing than the second withdrawal position. For this, while the second hood 230 is taken out of the hood casing 210, a bottom surface of the second stopper 237 contacts a top surface of the hook rib 215.

The guide member 240 allows the first hood 220 to be taken in or out of the hood casing 210, i.e., guides sliding of the first hood 220 with respect to the hood casing 210. A rail assembly including first and second rails 241 and 243 may be used as the first guide member 240. The first rail 241 is fixed to the insides of both side surfaces of the hood casing 210. Also, the second rail 243 is fixed to the outsides of both side surfaces of the first hood 220. Since the second rail 243 is slid along the first rail 241, the first hood 220 is slid forward and backward with respect to the hood casing 210. Thus, the first and second rails 241 and 243 may be called a fixed rail and a movable rail, respectively. However, it is not necessary that the guide member 240 should be used as the above-described rail assembly. That is, if the guide member 240 guides movement of the first hood 220, any component may be used as the guide member 240. For example, the guide member 240 may include a rail disposed on the bottom surface of the hood casing 210 and a roller disposed on both side surfaces of the first hood 220 to move along the rail.

The tilting control device 250 selectively allows or restricts the second hood 230 to be taken in or out of the hood casing 210 by the self-weight of the second hood 230. Also, the tilting control device 250 guides the second hood 230 to be taken in or out of the hood casing 210.

The tilting control device 250 restricts the second hood 230 to be taken out of the hood casing 210 when the first hood 220 is disposed at the first accommodation position at which the first hood is accommodated within the hood casing 210. Also, the tilting control device 250 allows the second hood 230 to be taken out of the hood casing 210 by the self-weight of the second hood 230 to guide the movement of the second hood 230 when the first hood 220 is disposed at the first withdrawal position at which the first hood 220 is taken out of the hood casing 210. That is to say, the tilting control device 250 may selectively transmit an external force due to the self-weight of the first hood 220 into the second hood 230. The tilting control device 250 includes first and second locking members 251 and 255.

In detail, the first locking member 251 is disposed on the first hood 220. Also, the second locking member 255 is disposed on the second hood 230. The first and second locking members 251 and 255 relatively move in contact or noncontact with each other by being linked with the withdrawal of the first hood 220 from/into the hood casing 210. Also, the first and second locking members 251 and 255 guide the withdrawal of the second hood 230 from/into the hood casing 210. For this, a length of each of the first and second locking members 251 and 255 may be determined within a contact range therebetween in the state where the first hood 220 is disposed at the first withdrawal position at which the first hood 220 is taken out of the hood casing 210. However, a length of each of the first and second locking members 251 and 255 may be determined within a range in which an interference between the first hood 220 and the hood casing 210 or between the first and second hoods 220 and 230 is prevented in the state where the first hood 220 is disposed at the first accommodation position at which the first hood 220 is accommodated within the hood casing 210. Also, in the state where the first hood 220 is disposed on the first withdrawal position at which the first hood 220 is taken out of the hood casing 210, a front end of the first locking member 251 may be disposed on a front side of at least the second suction hole 231.

The first locking member 251 extends backward from a rear end of the first hood 220. A locking surface 252 and a guide surface 253 are disposed on a bottom surface of the first locking member 251. The locking surface 252 is disposed on a front end of the first locking member 251. For example, the locking surface 252 may be a horizontal plane. Also, the guide surface 253 inclinedly extends upward from a rear end of the locking surface 252 toward a rear side of the first hood 220 at a predetermined angle.

The second locking member 255 extends forward from a front end of the second hood 230, substantially, a front end of the second hood 230 corresponding to a front side of the tilting pin 233. Substantially, the second locking member 255 may be integrated with the bottom surface of the second hood 230. The second locking member 255 contacts the first locking member 251, substantially, the locking surface 252 and the guide surface 253. Also, the second locking member 255 relatively moves along the guide surface 253 in a state where the second locking member 255 is in contact with the guide surface 253 according to the withdrawal of the first hood 220 from the hood casing 210.

That is, in the state where the first hood 220 is disposed at the first accommodation position at which the first hood 220 is accommodated within the hood casing 210, the second locking member 255 is in contact with the locking surface 252. As described above, in the state where the second locking member 255 is in contact with the locking surface 252, since the tilting of the second hood due to a self-weight thereof is restricted, the second hood 230 may be maintained at the second accommodation position. That is, since the first hood 220 presses the locking surface 252 in the state where the second locking member 255 is in contact with the locking surface 252, the tilting of the second hood 230 may be restricted.

Also, when the first hood 220 is taken out of the hood casing 210, i.e., moves from the first accommodation position to the first withdrawal position at which the first hood 220 is taken out of the hood casing 210, the second locking member 255 is spaced apart from the locking surface to allow the second hood 230 to be tilted by the self-weight thereof. Here, the second locking member 255 relatively moves along the guide surface 253 in a state where the second locking member 255 is in contact with the guide surface 253 to guide the second hood 230 so that the second hood 230 is taken out of the hood casing 210, i.e., tilted. That is to say, when the second locking member 255 relatively moves along the guide surface 253, the second hood 230 moves from the second accommodation position at which the second hood 230 is accommodated within the hood casing 210 to the second withdrawal position at which the second hood 230 is taken out of the hood casing 210. Here, substantially, the second locking member 255 may relatively move along the guide surface 253 to reduce a tilting speed of the second hood 230.

Although not shown, the hood device 200 may further include a driving device. The driving device controls an operation of the first hood 220 that is taken in or out of the hood casing 210. Alternatively, a separate driving device may not be provided, and a user may directly take the first hood 220 in or out of the hood casing 210.

For example, the driving device may include a driving member and a driving force transmission member. The driving member provides a driving force for taking the first hood 220 in or out of the hood casing 210 by user's manipulation. Also, the driving force transmission member transmits the driving force of the driving member to the first hood 220. For example, a driving motor may be used as the driving member. Also, at least one gear may be used as the driving force transmission member.

For another example, the driving device may include an elastic member and a locking device. The elastic member provides an elastic force in a direction in which the first hood 220 is taken out of the hood casing 210, i.e., the first hood 220 moves to the first withdrawal position. Thus, the first hood 220 is taken out of the hood case 210 by the elastic force of the elastic member. Then, the locking device may prevent the first hood 220 from randomly moving to the first withdrawal position at which the first hood 220 is taken out of the hood casing 210 in the state where the first hood 220 is accommodated within the hood casing 220, i.e., the first hood 220 is disposed at the first accommodation position. In other words, the locking device selectively enables the sliding of the first hood 220 by the elastic force of the elastic member in the state where the first hood 220 is disposed at the first accommodation position. For example, a coil spring a leaf spring may be used as the elastic member. The coil spring may be fixed to the hood casing 210 and the first hood 220, or both ends of the first and second rails 241 and 243. Also, an end of the leaf spring may be fixed to the first hood 220 in a state where the leaf spring is wound around a drum disposed within the hood casing 210. Also, the locking device may include a latch module (not shown) and a latch hook (not shown). The latch module may be fixed to the hood casing 210, and the latch hook may be fixed to the first hook 220. Also, since the latch hook is selectively engaged with the latch module by an external force applied into the first, hood 220 in the direction in which the first hood 220 is accommodated into the hood casing 210, the sliding of the first hood 220 with respect to the hood casing 210 may be selectively enabled.

Also, the hood device 200 may further include a lamp (not shown). The lamp may illuminate a lower side of the microwave oven 100, i.e., a cooking appliance 1. Here, the lamp may be disposed on the first hood casing 210 or one or all of the first and second hoods 230.

The suction fan assembly 260 is disposed within the main body 110. The suction fan assembly 260 suctions air containing contaminants into the main body 110 to discharge the air to the outside of the main body 110, i.e., into the indoor or outdoor space. That is, when the suction fan assembly 260 is driven, the air containing the contaminants is suctioned into the main body 110 through the first and second suction holes 221 and 231. Also, the air containing the contaminants suctioned into the main body 110 flows into the main suction passage P3, the first and second suction passages P4 and P5, the connection passage P1 or/and the indoor exhaust passage P2 by the continuous operation of the suction fan assembly 260, and then is discharged into the indoor or outdoor space through the indoor exhaust hole 117 or the outdoor exhaust hole 118. In the current embodiment, the suction fan assembly 260 is disposed on a connection portion between the connection passage P1 and the indoor exhaust passage P2.

Figure 3:
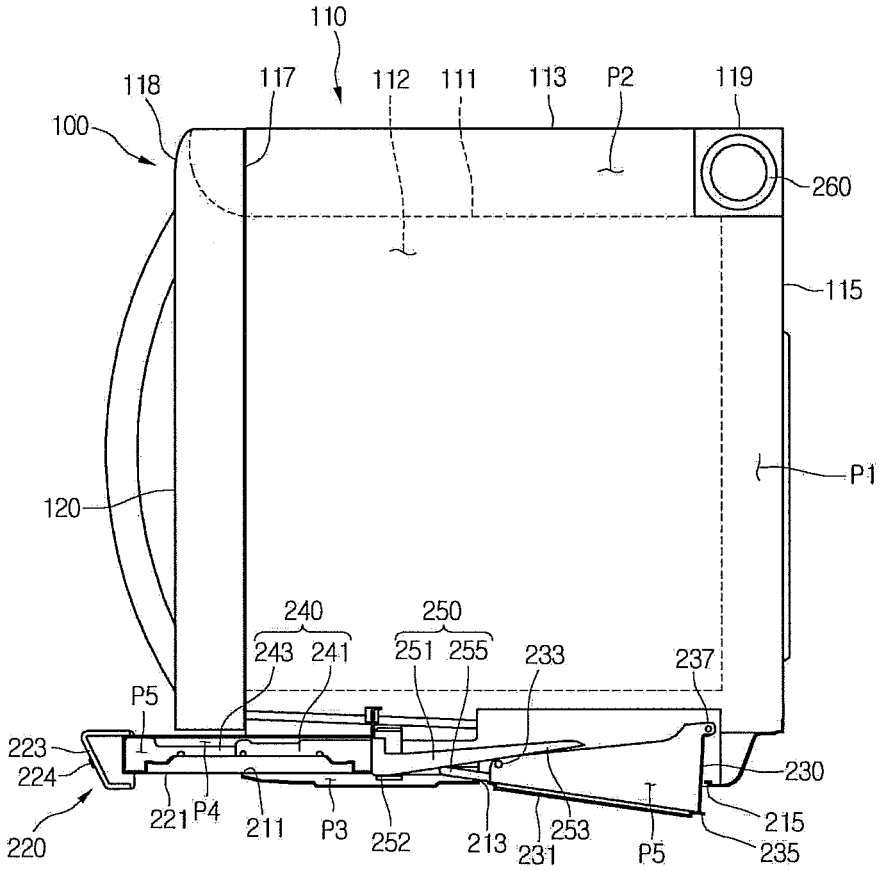
FIGS. 3 and 4 are views illustrating an operation of the hood of the microwave oven having the hood according to an embodiment.
Figure 4:
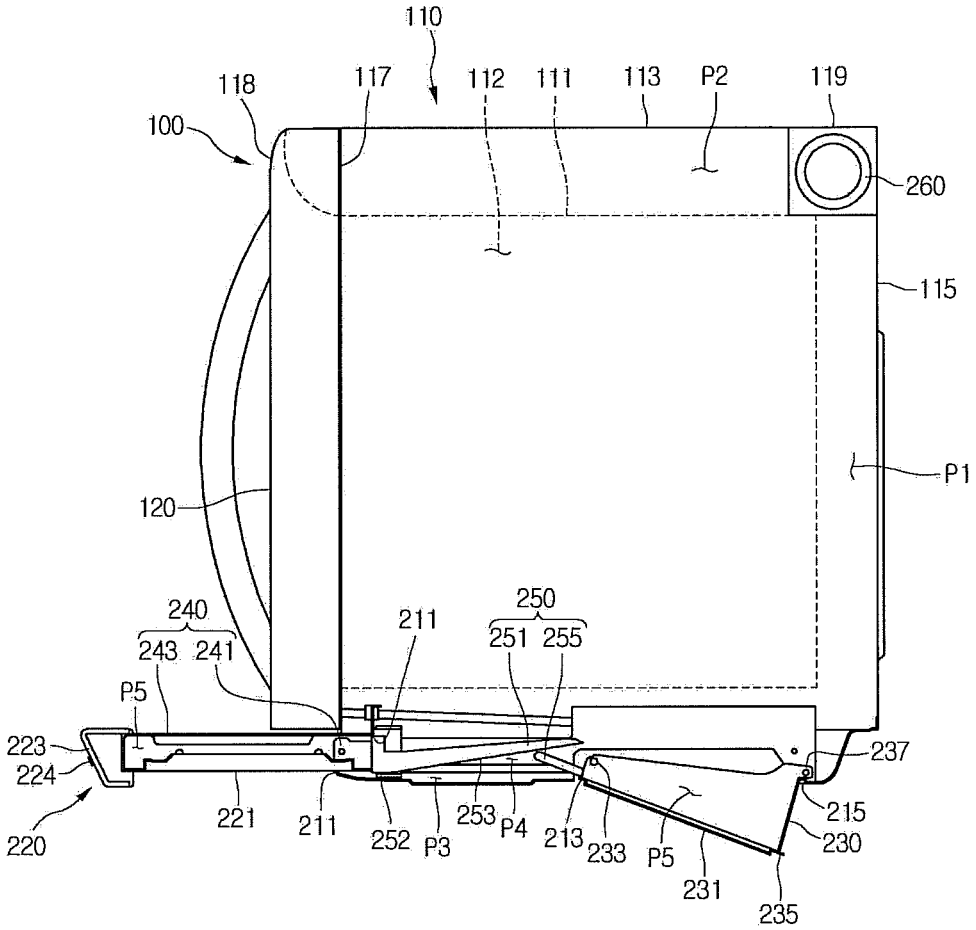

FIGS. 3 and 4 are views illustrating an operation of the hood of the microwave oven having the hood according to an embodiment.

Referring to FIG. 3, the user takes the first hood 220 out of the hood casing 210 in the state where the first and second hoods 220 and 230 are accommodated within the hood casing 210, i.e., the first and second hoods 220 and 230 are respectively disposed at the first and second accommodation positions. Alternatively, when a separate driving device is provided, the first hood 220 may be tanked out by an operation of the driving device (for example, a driving operation of the driving motor or a locking release operation of the locking device). Also, when the first hood 220 is taken out of the hood casing 210, i.e., moves to the first withdrawal position, the second hood 230 may also be taken out of the hood casing 210, i.e., move to the second withdrawal position by being linked with the operation of the first hood 220.

In more detail, the first hood 220 moves to the first accommodation position illustrated in FIG. 2 in a left direction as shown in FIGS. 3 and 4 and then is disposed at the first withdrawal position. Here, the withdrawal of the first hood 220 is guided by the first guide member 240. That is, when the first hood 220 moves in the left direction in the drawings, the withdrawal of the first hood 220 is guided while the second rail 243 moves along the first rail 241 in the left direction in the drawings.

In the state where the first hood 220 is disposed at the first accommodation position at which the first hood 220 is accommodated into the hood casing 210, the second hood 230 may be maintained at the second accommodation position at which the second hood 230 is accommodated into the hood casing 210. That is, since the second locking member 255 is maintained in contact with the locking surface 251, the second hood 230 may not be tilted with respect to the tilting pin 233 by the self-weight thereof.

In this state, when the first hood 220 is taken out of the hood casing 210, the first hood 220 moves in the left direction in FIGS. 3 and 4 to allow the second locking member 255 to contact a bottom surface of the first locking member 251, i.e., the guide surface 253. Also, the first hood 220 may continuously move to allow the second locking member 255 to move along the guide surface 253. Then, the second hood 230 may be tilted with respect to the tilting pin 233 and thus taken out of the hood casing 210. Substantially, when the withdrawal of the first hood 220 is finished, i.e., the first hood 220 is disposed at the first withdrawal position at which the first hood 220 is taken out of the hood casing 210, the tilting of the second hood 230 is finished. However, in the current embodiment, even though the first hood 220 is abnormally taken out, since the second stopper 237 is hooked on the hook rib 215, the second hood 230 may be maintained at the second withdrawal position.

As described above, in the state where the first and second hoods 220 and 230 are taken out of the hood casing 210, when the suction fan assembly 260 operates, the air containing the contaminants is suctioned into the main body 110. Also, the air containing the contaminants suctioned through the first and second suction holes 221 and 231 flows into the main suction passage P3 or the first and second suction passages P4 and P5 and the main suction passage P3 and then is transferred into the connection passage P1. The air containing the contaminants transferred into the connection passage P1 flows into the indoor exhaust passage P2 and then is discharged into the indoor space through the indoor exhaust hole 117 or into the outdoor space through the outdoor exhaust hole 118.

The process for receiving the first and second hoods 220 and 230 into the hood casing 210, i.e., the process for moving the first and second hoods 220 and 230 from the first and second withdrawal positions to the first and second reception positions may be reversely performed with respect to the above-described withdrawal process. That is, when the user applies an external force to the first hood 220 in the direction in which the first hood 220 is accommodated into the hood casing 210, i.e., in the left direction in the drawings, the first hood is accommodated into the hood casing 210. As described above, when the first hood 220 is accommodated into the hood casing 210, the second rail 243 moves along the first rail 41 in a right direction in the drawings.

Also, when the first hood 220 moves in the right direction in the drawings so that the first hood 220 is accommodated into the hood casing 210, the second locking member 255 relatively moves along the guide surface 253. Thus, the second hood 230 rotates in the direction in which the second hood 230 is accommodated into the hood casing 210 at the second withdrawal position at which the second hood 230 is taken out of the hood casing 210. Also, when the first hood 220 is disposed at the first accommodation position at which the first hood 220 is accommodated into the hood casing 210, since the second locking member 255 contacts the locking surface 251, the second hood 230 is disposed at the second accommodation position at which the second hood 230 is accommodated into the hood casing 210. Also, when the second hood 230 is disposed at the second accommodation position at which the second hood 230 is accommodated into the hood casing 210, the first stopper 235 is hooked on the hook rib 215. Thus, it may prevent the second hood 230 from being continuously accommodated into the hood casing 210.

Figure 5:
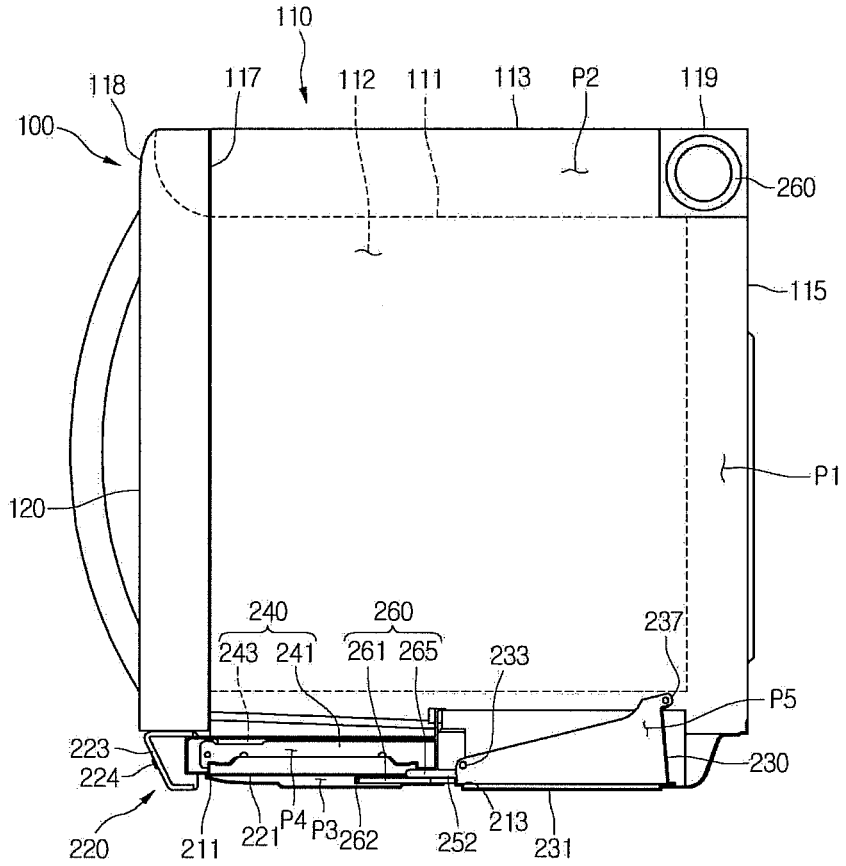
FIGS. 5 and 6 are cross-sectional views of a microwave oven having a hood according to another embodiment.
Figure 6:
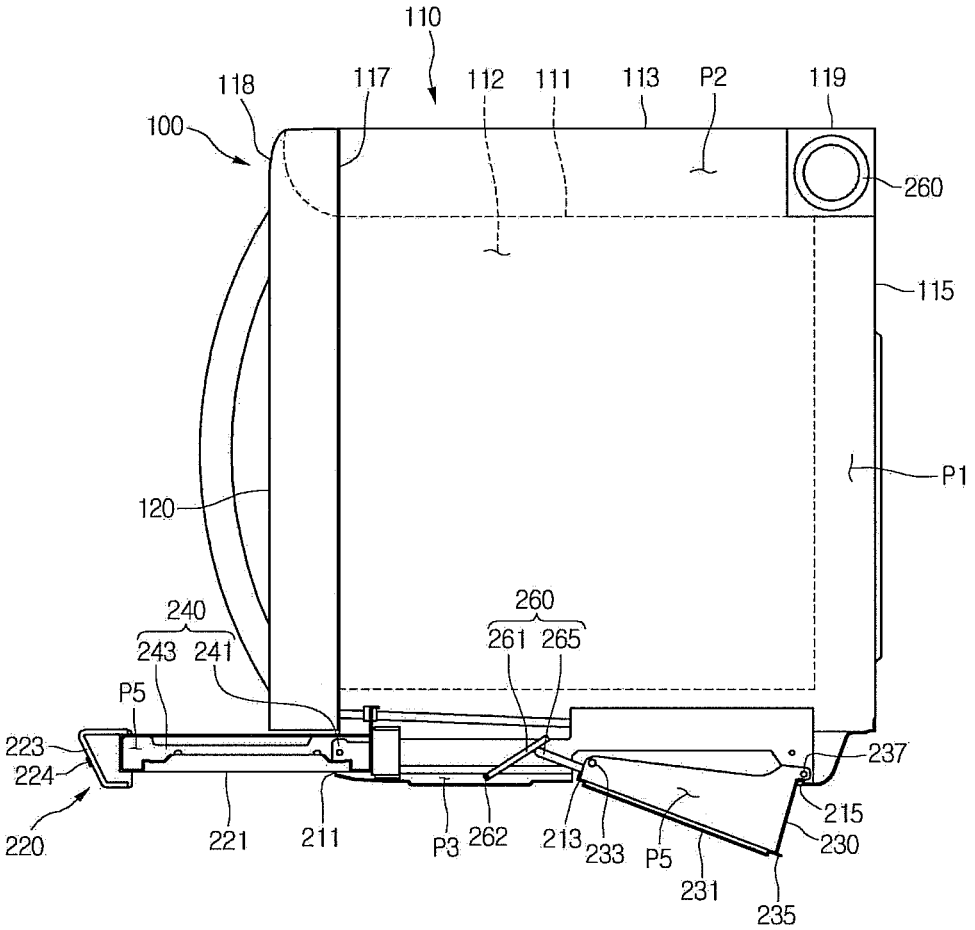

FIGS. 5 and 6 are cross-sectional views of a microwave oven having a hood according to another embodiment. The same components as those of the foregoing embodiment will be derived from FIGS. 1 to 4, and thus detailed descriptions thereof will be omitted.

Referring to FIGS. 5 and 6, in the current embodiment, a tilting control device 260 includes first and second locking members 261 and 265. The first locking member 261 is rotatably disposed within a hood casing 210. Also, the second locking member 265 is disposed on a front end of a second hood 230.

In detail, a rotation pin 262 is disposed on the first locking member 261. The rotation pin 262 extends horizontally from both sides of a front end of the first locking member 261. Also, the first locking member 261 rotates about the rotation pin 262 and is disposed at a first rotation position (see FIG. 5) and a second rotation position (see FIG. 6). The rotation of the first locking member 261 may be performed by being linked with the withdrawal of the first and second hoods 230 from/into the hood casing 210. That is, in the state where the first hood 220 is disposed at a first accommodation position at which the first hood 220 is accommodated within the hood casing 210, the first locking member 261 is disposed at the first rotation position. Also, in the state where the first hood 220 is disposed at a first withdrawal position at which the first hood 220 is taken out of the hood casing 210, the first locking member 261 rotates by the second hood 230 and then is disposed at the second rotation position. For this, in the current embodiment, an external force applied in a direction in which the second hood 230 is taken out of the hood casing 210 by a self-weight of the second hood 230 is relatively greater than that acting on the second locking member 265, substantially, the second hood 230 by self-weights of the first hood 210 disposed at the first accommodation position and the first locking member 261 disposed at the first rotation position. Also, the external force applied in a direction in which the second hood 230 is taken out of the hood casing 210 by the self-weight of the second hood 230 is relatively greater than that acting on the second locking member 265 by the self-weight of the first locking member 261 disposed at the first rotation position.

The second locking member 265 may be maintained in contact with one side of the first locking member 261 according to the rotation of the first locking member 261 or relatively move along the first locking member 261 in contact with the first locking member 261. That is, when the first locking member 261 is disposed at the first rotation position, the second locking member 265 is maintained in contact with a bottom surface of the first locking member 261. Also, when the first locking member is disposed at the second rotation position, the second locking member 265 relatively moves the bottom surface of the first locking member 261 in a state where the second locking member 265 is in contact with the bottom surface of the first locking member 261 by the tilting of the second hood 230.

In the current embodiment, when the first hood 220 is disposed at the first accommodation position at which the first hood 220 is accommodated into the hood casing 210, an external force is applied into the first locking member 261 by the first hood 220. Thus, the first locking member 261 is maintained at the first position, and the tilting of the first locking member 261 due to the self-weight of the second hood 230 is restricted.

When the first hood 220 is disposed at the first withdrawal position at which the first hood 220 is taken out of the hood casing 210, the external force applied into the first locking member 261 is removed by the self-weight of the first hood 210. Thus, since only the external force due to the self-weight of the second hood 230 is applied into the first locking member 261, the first locking member 261 rotates about the rotation pin 262 and then is disposed at the second rotation position. Also, the second hood 230 is tilted with respect to the hood casing 210 by the self-weight thereof. Here, since the second locking member 265 relatively moves in contact with the bottom surface of the first locking member 261, a tilting speed of the second hood 230 may be substantially reduced.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the foregoing embodiments, a hood slidable with respect to the hood casing was called the first hood, and a hood tiltable with respect to the hood casing was called the second hood. Thus, the first and second hood may be called a sliding hood or a tilting hood according to the moving method with respect to the hood casing.

Also, the hook rib and the first and second stoppers substantially restrict the tilted angle of the second hood with respect to the hood casing. Thus, the hook rib and the first and second stoppers may be called a stopping member.

Also, in the foregoing embodiment, the first locking member is disposed on the first hood, and the second locking member is disposed on the second hood. However, the first locking member may be disposed on the second hood, and the second locking member may be disposed on the first hood.

In the foregoing embodiment, the elastic member applying the elastic force for allowing the second locking member to be disposed at the second rotation position into the second locking member may be provided.

For another example, the second hood 230 dose not suction an air but guide the air toward the first suction hole 221 of the first hood 220. That is, the second hood 230 may not comprises a suction hole.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microwave oven having a hood, the microwave oven comprising:

a main body having a cooking chamber in which foods are cooked and a passage through which air containing contaminants flows;

a hood casing disposed on a lower portion of the main body;

a first hood taken out of the hood casing;

a second hood tilted at a position different from that of the first hood, the second hood to be taken out of the hood casing;

a tilting pin disposed on the second hood, wherein the tilting pin is rotatably supported within the hood casing to provide a tilting center of the second hood; and a tilting control device that allows or restricts tilting of the second hood due to a self-weight of the second hood, wherein the tilting control device reduces a tilting speed of the second hood when tilting of the second hood is allowable due to the self-weight of the second hood, wherein the tilting control device includes:

a first locking member disposed on the first hood, the first locking member extending backward from the first hood, and a second locking member disposed on the second hood, the second locking member extending forward from a front side of the tilting pin, wherein the first hood and the second hood are provided with a suction hole, respectively, wherein air is suctioned into the passage through the suction hole, when the first hood is taken out of the hood casing, the second locking member relatively moves along the first locking member in a state where the second locking member is in contact with the first locking member to reduce a tilting speed of the second hood.

2. The microwave oven according to claim 1, wherein the tilting control device adjusts the tilting speed of the second hood according to movement of the first hood.

3. The microwave oven according to claim 1, wherein, when the first hood is accommodated into the hood casing, the second locking member is maintained in contact with the one side of the first locking member to restrict the tilting of the second hood.

4. The microwave oven according to claim 1, wherein the first locking member comprises:

a locking surface contacting the second locking member when the first hood is accommodated into the hood casing; and a guide surface relatively moving in contact with the second locking member when the first hood is taken out of the hood casing when the first hood is accommodated into the hood casing.

5. The microwave oven according to claim 4, wherein the locking surface is a horizontal plane, and the guide surface inclinedly extends from the locking surface.

6. The microwave oven according to claim 1, further comprising a stopping member for restricting a tilted angle of the second hood with respect to the hood casing.

7. The microwave oven according to claim 6, wherein the stopping member comprises:

a hook rib disposed on the hood casing;

a first stopper hooked on the hook rib when the second hood is accommodated into the hood casing; and a second stopper hooked on the hook rib when the second hood is taken out of the hood casing.

8. The microwave oven according to claim 7, wherein, when the second stopper is hooked on the hook rib, a bottom surface of the second hood is disposed on the same virtual plane as the hood casing.

9. The microwave oven according to claim 1, wherein the first hood is slidably taken out of the hood casing, and when the first hood is taken out of the hood casing by a predetermined distance, the tilting of the second hood starts.

10. A microwave oven having a hood, the microwave oven comprising:

a main body having a cooking chamber in which foods are cooked and a passage through which air containing contaminants flows;

a hood casing disposed on a bottom surface of the main body;

a first hood to slide forward or backward with respect to the hood casing so that the first hood is taken out of the hood casing;

a second hood tilted at a predetermined angle with respect to the hood casing so that the second hood is taken out of the hood casing;

a tilting pin disposed on the second hood, wherein the tilting pin is rotatably supported within the hood casing to provide a tilting center of the second hood; and a tilting control device restricting tilting of the second hood when the first hood is accommodated into the hood casing, wherein the tilting control device reduces a tilting speed of the second hood while the second hood is tilting, wherein the tilting control device includes:

a first locking member rotatably disposed within the hood casing, the first locking member being pressed by the first hood; and a second locking member disposed on the second hood and extending forward from a front side of the tilting pin, the second locking member being pressed by the first locking member, wherein the first hood and the second hood are provided with a suction hole, respectively, wherein air is suctioned into the passage through the suction hole.

11. The microwave oven according to claim 10, wherein the tilting control device adjusts the tilting speed of the second hood according to movement of the first hood.

12. The microwave oven according to claim 10, wherein, when the first hood is accommodated into the hood casing, the first hood presses the first locking member to restrict rotation of the second locking member, and when the first hood is taken out of the hood casing, a pressing force of the first hood applied into the first locking member is removed so that the first locking member rotates by the second hood.

13. The microwave oven according to claim 10, further comprising a tilting restriction part restricting a tilted angle of the second hood.

14. A microwave oven comprising:

a body having a cooking chamber and a passage through which air flows;

a hood casing at a lower portion of the body;

a first hood to be provided out from the hood casing;

a second hood to be provided out from the hood casing, the second hood to tilt at a position different from the first hood;

a tilting pin at the second hood rotatably supported within the hood casing, the tilting pin to provide a tilting point of the second hood such that the second hood may tilt relative to the tilting point; and a tilting control device to allow or restrict tilting of the second hood based on a self-weight of the second hood, wherein the tilting control device reduces a tilting speed of the second hood when tilting of the second hood is allowable due to the self-weight of the second hood, wherein the tilting control device includes:

a first locking member at the first hood, the first locking member extending backward from the first hood, and a second locking member at the second hood, the second locking member extending forward from a front side of the tilting pin, wherein the first hood and the second hood are provided with a suction hole, respectively, wherein air is suctioned into the passage through the suction hole, when the first hood is provided out from the hood casing, the second locking member relatively moves along the first locking member in a state where the second locking member is in contact with the first locking member to reduce a tilting speed of the second hood.

15. The microwave oven according to claim 14, wherein the tilting point is a tilting center of the second hood.

* * * * *